US012158016B2

(12) United States Patent
Tassinari

(10) Patent No.: US 12,158,016 B2
(45) Date of Patent: Dec. 3, 2024

(54) EQUIPMENT FOR BURYING POLES INTO THE GROUND

(71) Applicant: ORTECO - S.r.l., Anzola dell'Emilia (IT)

(72) Inventor: Sergio Tassinari, Anzola dell'Emilia (IT)

(73) Assignee: ORTECO - S.r.l., Anzola dell'Emilia (IT)

( * ) Notice: Subject to any disclaimer, the term of this patent is extended or adjusted under 35 U.S.C. 154(b) by 347 days.

(21) Appl. No.: 17/632,019

(22) PCT Filed: Jul. 29, 2020

(86) PCT No.: PCT/IB2020/057134
§ 371 (c)(1),
(2) Date: Feb. 1, 2022

(87) PCT Pub. No.: WO2021/024097
PCT Pub. Date: Feb. 11, 2021

(65) Prior Publication Data

US 2022/0275662 A1 Sep. 1, 2022

(30) Foreign Application Priority Data

Aug. 2, 2019 (IT) ..... 102019000013833

(51) Int. Cl.

| | |
|---|---|
| ***E04H 12/34*** | (2006.01) |
| ***E02D 7/02*** | (2006.01) |
| ***E04H 17/26*** | (2006.01) |
| *E02D 7/06* | (2006.01) |

(52) U.S. Cl.
CPC ..... *E04H 12/347* (2013.01); *E02D 7/02* (2013.01); *E04H 17/263* (2013.01); *E02D 7/06* (2013.01)

(58) Field of Classification Search
CPC ..... E02D 7/02; E02D 7/10; E04H 12/347; E04H 17/263
See application file for complete search history.

(56) References Cited

U.S. PATENT DOCUMENTS

| | | | | |
|---|---|---|---|---|
| 5,375,664 | A * | 12/1994 | McDowell | E02D 7/18 173/147 |
| 9,464,398 | B2 * | 10/2016 | Korherr | E02D 11/00 |
| 2022/0396965 | A1 * | 12/2022 | Tassinari | E04H 12/347 |

FOREIGN PATENT DOCUMENTS

| | | | | |
|---|---|---|---|---|
| AU | 2019214833 | A1 * | 8/2020 | B63B 35/003 |
| CN | 106088788 | A * | 11/2016 | E04H 12/34 |
| CN | 105507320 | B * | 4/2017 | |
| CN | 107709670 | A * | 2/2018 | E02D 11/00 |
| CN | 107 964 953 | A | 4/2018 | |
| CN | 106948644 | B * | 1/2019 | B66F 11/00 |
| CN | 109610924 | A * | 4/2019 | E04H 12/34 |
| CN | 113981969 | A * | 1/2022 | |

(Continued)

*Primary Examiner* — Frederick L Lagman
(74) *Attorney, Agent, or Firm* — ASLAN LAW, P.C.

(57) ABSTRACT

Equipment for burying poles into the ground. The equipment includes a base frame associable with a machine for the movement of the equipment; a hammering assembly associated movable with the base frame and adapted to bury a pole to allow its at least partial penetration into the ground at a burying position; and a gripping and positioning assembly of the pole, associated with the base frame and adapted to grasp the pole and to position it under the hammering assembly at the burying position.

14 Claims, 7 Drawing Sheets

(56) References Cited

FOREIGN PATENT DOCUMENTS

| | | | | | |
|---|---|---|---|---|---|
| CN | 113982360 | A | * | 1/2022 | |
| EP | 0 902 128 | A2 | | 3/1999 | |
| GB | 2447785 | A | * | 9/2008 | ..... E02D 7/02 |
| GB | 771037 | A | * | 3/2017 | |
| RU | 2 623 786 | C1 | | 6/2017 | |
| WO | WO 85/02224 | A1 | | 5/1985 | |
| WO | WO 2017/066833 | A1 | | 4/2017 | |

* cited by examiner

EQUIPMENT FOR BURYING POLES INTO THE GROUND

CROSS-REFERENCE TO RELATED APPLICATIONS

This application claims priority to IT patent application Ser. No. 102019000013833 filed on Aug. 2, 2019, and this application claims priority to and is a 371 of international PCT Application No. PCT/IB2020/057134 filed on Jul. 29, 2020, the entire contents of which are hereby incorporated by reference.

TECHNICAL FIELD

The present invention relates to a piece of equipment for burying poles into the ground.

BACKGROUND ART

Well-known equipment is used for burying poles into the ground, commonly known as pole drivers.

Pole drivers are used in very different fields of application, for example in the construction of photovoltaic fields, road safety systems (guard rails) or fencing structures.

Pole drivers of known type may be of a different nature depending on the size and nature of the pole on which they are to operate and depending on the ground on which they are to work and comprise a pole hammering assembly which, after being started, exerts pressure and/or hammers the pole so that it penetrates into the ground.

Usually, pole drivers of known type are associable with appropriate dedicated vehicles or with conventional vehicles such as, e.g., tractors, forklifts, excavators that allow their movement on the ground on which they have to work.

When using the known type of pole drivers, it is envisaged to position the poles with one end contacting the ground and let them penetrate into the ground itself through the hammering assembly which is positioned at the end of the pole opposite the end contacting the ground.

Pole drivers of known type do have some drawbacks.

First of all, the pole drivers of known type do not allow for the easy and safe performance of the ground mapping phase, i.e. the phase of identifying the installation points of the poles.

In fact, a project is usually provided to the work team in which the mapping of the installation points is schematized and, afterwards, one or more operators move on the ground in order to identify the exact position of the installation points through appropriate surveys.

It is easy to guess how the above mentioned method of soil mapping is carried out with a very long time frame, especially if the intervention ground is very large.

In addition, if the soil is difficult for the operator to walk on, due to the morphological characteristics of the soil itself, or if the surrounding environment has adverse climatic conditions, the mapping operation can be dangerous for the operator.

In addition, the level of accuracy can sometimes be unsatisfactory due to operator's errors that may have occurred during the identification of the installation points on the ground.

Furthermore, the pole drivers of known type do not allow for the practical and safe positioning and burying of the poles into the ground.

One or more operators usually lift the pole to be driven into the ground vertically and manually hold it in that position when burying the pole itself into the ground by means of the pole driver.

It is easy to guess how the positioning of the poles carried out according to the above mentioned methods can require very long execution times and can be dangerous for the operators because during the burying phase they are near the hammered or pushed pole, risking to be hit by the hammering assembly or by the pole itself.

Furthermore, if the poles to be moved are particularly long and/or heavy it can be very difficult if not impossible for the operator to move and hold them.

DESCRIPTION OF THE INVENTION

The main aim of the present invention is to devise a piece of equipment for burying poles into the ground that will enable the phase of burying poles into the ground to be carried out quickly and safely, even in the case of large and particularly heavy poles.

Another object of the present invention is to devise a piece of equipment for burying poles into the ground that allows performing the ground mapping phase quickly and easily while reducing the use of manpower and the timing of implementation.

Another object of the present invention is to devise a piece of equipment for burying poles into the ground that allows overcoming the above mentioned drawbacks of the prior art in a simple, rational, easy, effective to use and low cost solution.

The objects set out above are achieved by the present piece of equipment for burying poles into the ground having the characteristics of claim 1.

The objects set out above are also achieved by the present system for the automatic control of a piece of equipment for burying poles into the ground according to claim 12.

BRIEF DESCRIPTION OF THE DRAWINGS

Other characteristics and advantages of the present invention will be more evident from the description of a preferred, but not exclusive, embodiment of a piece of equipment for burying poles into the ground, illustrated by way of an indicative, yet non-limiting example, in the attached tables of drawings in which.

EMBODIMENTS OF THE INVENTION

Figure 1:
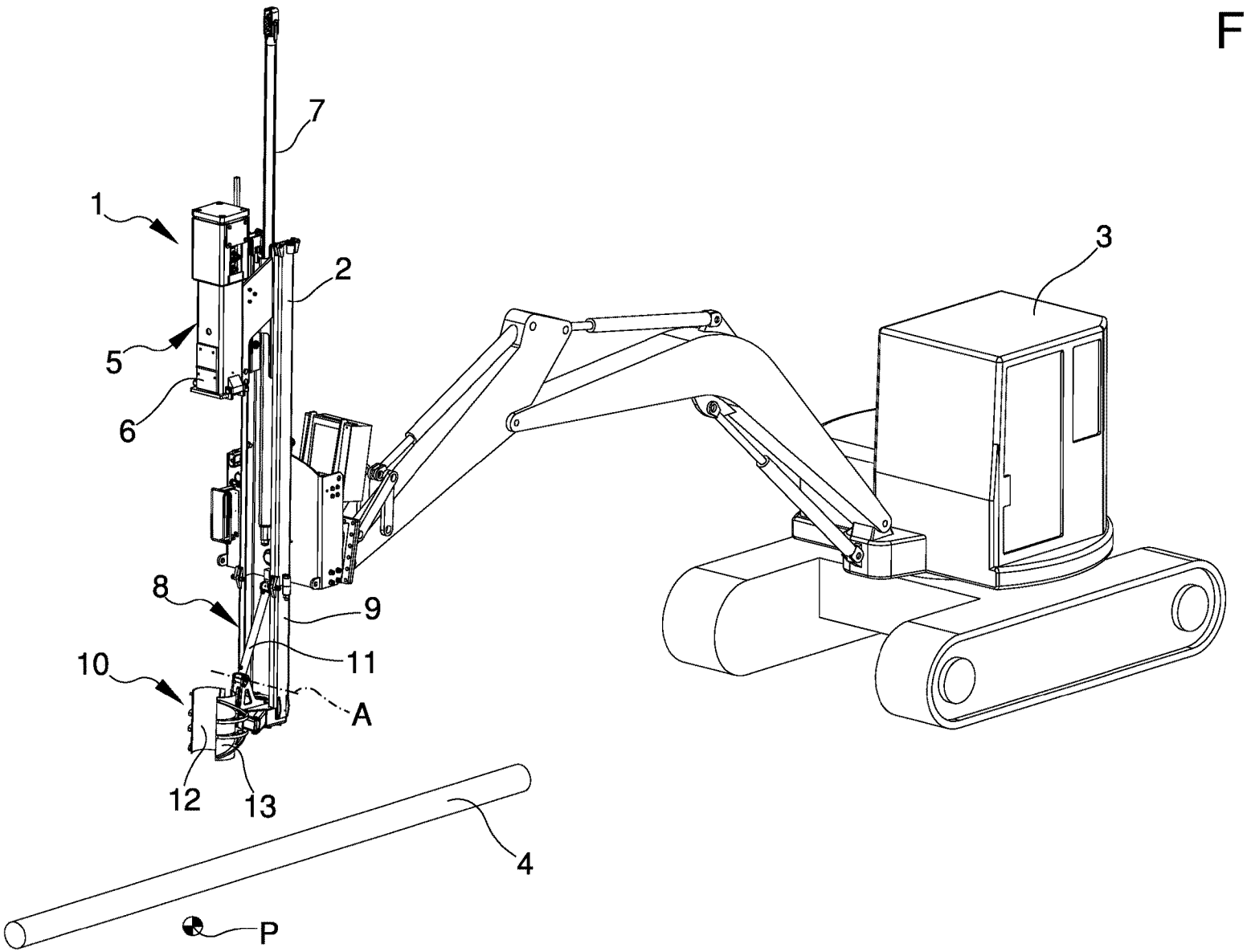
FIGS. 1 to 6 are axonometric views of a piece of equipment according to the invention at different phases of work during the burying of a pole into the ground.

With particular reference to these figures, reference numeral 1 globally indicates a piece of equipment for burying poles into the ground.

The equipment 1 comprises at least one base frame 2 associable with at least one machine for the movement 3 of the equipment 1.

The equipment 1 is used to bury at least one pole 4 onto a work ground and, during its use, is associated with the machine for the movement 3 in order to be easily moved on the work ground according to the working needs.

In addition, the machine for the movement 3 comprises a power supply assembly that supplies the mechanical energy required to operate the equipment 1.

The machine for the movement 3, in the particular embodiment shown in the figures, comprises an excavator and the equipment 1 is associated with the excavator at the free portion of the excavator arm.

Alternative embodiments wherein the machine for the movement 3 is of a different nature cannot, however, be ruled out; for example, the machine for the movement 3 may consist of a tractor or a forklift truck.

The base frame 2 comprises, e.g., a metal upright associable with the excavator arm.

The equipment 1 comprises at least one hammering assembly 5 associated movable with the base frame 2 and adapted to bury the pole 4 to make it penetrate at least partly into the ground at a burying position P.

The burying position P is established prior to the use of the equipment 1 and corresponds to the point on the ground where the pole 4 is to be buried in.

Thanks to the machine for the movement 3, the equipment 1 can be easily moved in order to reach the burying position P.

It should be noted that the equipment 1 is usually used to bury a plurality of poles 4 into the ground, each in a different burying position P.

The machine for the movement 3 allows displacing the equipment 1 so as to reach the burying position P relative to each pole 4.

The hammering assembly 5 usefully comprises at least one hammering device 6 associated with the base frame 2 in a sliding manner along a substantially vertical sliding direction S.

Precisely, the base frame 2 comprises a guide element and the hammering device 6 is associated in a sliding manner with the guide element along the sliding direction S.

After the pole 4 has been arranged at the burying position P, the hammering device 6 contacts the upper end of the pole 4.

Next, the hammering device 6 is made to slide along the guide element towards the ground, thus exerting a thrust on the pole 4 or hammering the pole 4 to make it penetrate into the ground.

Conveniently, the hammering assembly 5 comprises operation means 7 associated with the base frame 2 and with the hammering device 6 and adapted to move the hammering device 6 along the sliding direction S.

According to the invention, the equipment 1 comprises at least one gripping and positioning assembly 8 of the pole 4, associated with the base frame 2 and adapted to grasp the pole 4 and to position it under the hammering assembly 5 at the burying position P.

The gripping and positioning assembly 8 comprises at least one arm 9 fixed to the base frame 2, so that the gripping and positioning assembly 8 is located under the hammering assembly 5 and faces the ground when using the equipment 1.

This way, the gripping and positioning assembly 8 can easily pick up the pole 4 from the ground and position it under the hammering assembly 5 which, then, pushes it or hammers it into the ground as described above.

Conveniently, the gripping and positioning assembly 8 comprises at least one gripping device 10 movable between:

- at least one gripping position wherein it is placed to grasp the pole 4 positioned on the ground; and
- at least one work position wherein it is placed to position the pole 4 vertically under the hammering assembly 5.

The gripping device 10 is associated with the arm 9 in a rotatable manner.

In particular, with reference to the preferred embodiment shown in the figures, the gripping device 10 is hinged to the arm 9 around a substantially horizontal axis of rotation A.

Figure 7:
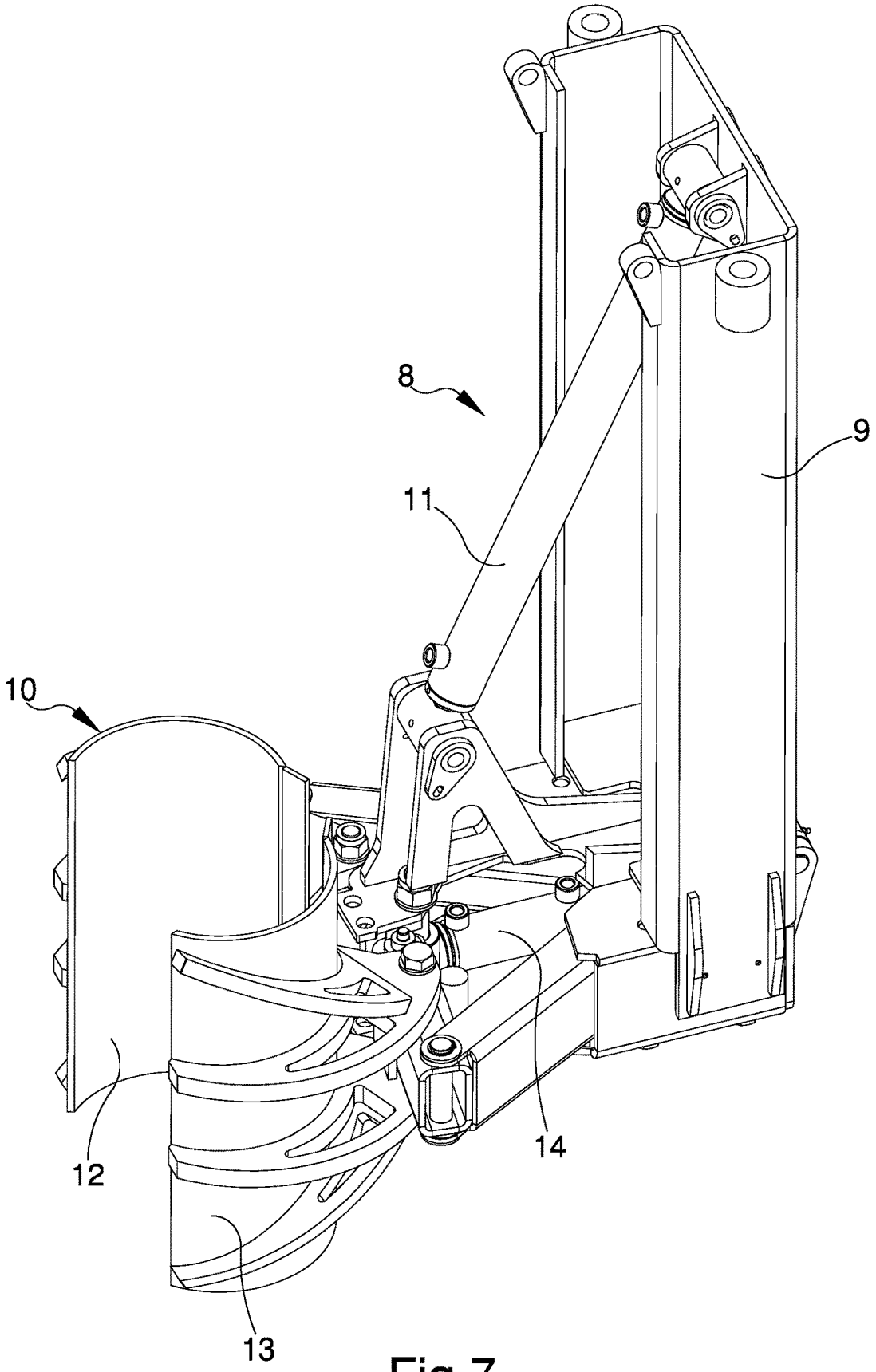
FIG. 7 is an axonometric, partly broken view of a detail of the equipment according to the invention.

As illustrated in detail in FIG. 7, the equipment 1 usefully comprises first actuating means 11 associated with the arm 9 and with the gripping device 10 and adapted to move the gripping device 10 between the gripping position and the work position.

Specifically, the first actuating means 11 comprise at least a first actuating cylinder 11 associated with the arm 9 and with the gripping device 10.

The first actuating cylinder 11 sets the gripping device 10 in rotation with respect to the arm 9 around the axis of rotation A, thus locating it alternately to the gripping position and to the work position.

Advantageously, the gripping device 10 comprises at least one gripper 12, 13 associated with the arm 9 and movable between at least one gripping position wherein it is placed to hold the pole 4 and at least one release position wherein it is placed to release the pole 4.

In particular, the gripper 12, 13 comprises at least a first jaw 12 and at least a second jaw 13 mutually opposite and associated with the arm 9 in a rotatable manner.

The first jaw 12 and the second jaw 13 have a substantially semi-cylindrical shape and internally define a substantially hollow portion.

The first jaw 12 and the second jaw 13 are associated with the arm 9 so that the concave portions of each jaw 12, 13 are mutually facing.

The first jaw 12 and the second jaw 13 are hinged to the arm 9 around their respective hinge axes B substantially orthogonal to the axis of rotation A.

The gripper 12, 13 is alternately located to the gripping position and to the release position by making the first jaw 12 and the second jaw 13 rotate around their respective hinge axes B.

Precisely, when the gripper 12, 13 is positioned in the gripping position, the first jaw 12 and the second jaw 13 are mutually moved close to each other to define a substantially hollow and substantially cylindrical housing compartment in which the pole 4 can be housed.

When, on the contrary, the gripper 12, 13 is positioned in the release position, the first jaw 12 and the second jaw 13 are moved away from each other.

As shown in detail in FIG. 7, the equipment 1 comprises second actuating means 14 associated with the arm 9 and with the gripper 12, 13 and adapted to move the gripper 12, 13 between the gripping position and the release position. The second actuating means 14 comprise a second actuating cylinder 14 which, by means of an articulated mechanism, moves the first jaw 12 and the second jaw 13 in rotation.

The system for the automatic control of the equipment 1 comprises:

- at least one management and control unit of the system;
- at least one storage unit of at least one burying position P of at least one pole 4 to be buried into the ground by means of the equipment 1.

The storage unit is operationally connected to the management and control unit. Usually, during the use of the equipment 1 it is envisaged to bury, in the work site, a plurality of poles 4, each of which must penetrate the ground at a precise burying position P.

Conveniently, the storage unit is adapted to store a plurality of burying positions P.

Advantageously, the system comprises acquisition means for the acquisition of the burying positions P operationally connected to the management and control unit.

The acquisition means of the burying positions P allow an operator to communicate to the management and control unit where it is necessary to bury the poles 4 into the work site.

The acquisition means comprise, e.g., a user interface, provided with a keypad and a monitor, which is used by the operator to enter the burying positions P within the storage unit.

The system comprises at least one location unit operationally connected to the management and control unit and adapted to identify the position of the equipment 1 and at least one display to show the burying positions P and the position of the equipment 1.

In particular, the location unit comprises at least one satellite navigation device (GPS, GLONASS, GNSS).

The satellite navigation device allows locating the exact position of the equipment 1 on the ground.

This way, an operator who is using the equipment 1 can see on the display the mutual positioning of the burying positions P in relation to the position of the equipment 1, possibly intervening on the positioning of the equipment 1 on the ground so that the equipment 1 itself intervenes at the burying positions P. Conveniently, the system comprises means for the definition of at least one route starting from the position of the equipment 1 to at least one burying position P.

This way the operator can easily operate the machine for the movement 3 by moving the equipment 1 along the identified route in order to locate the equipment 1 at the burying positions P.

The system comprises control means for controlling the equipment 1, through which the operator can easily drive the equipment 1 along the identified route. Conveniently, the control means are operationally connected to the first actuating means 11, to the second actuating means 14 and to the operation means 7.

This way, the operator can manage both the movement of the equipment 1 on the work site and intervene directly on the operation of the equipment 1 by starting the hammering assembly 5 and the gripping and positioning assembly 8 and by adjusting the operation thereof.

The control means, e.g., comprise a radio wave control device.

The operation of the equipment 1 according to the invention is substantially as follows.

The machine for the movement 3 is operated and managed in such a way as to position the equipment 1 in the proximity to the burying position P relative to the pole 4 which must be buried into the ground, as shown in FIG. 1.

Figure 2:
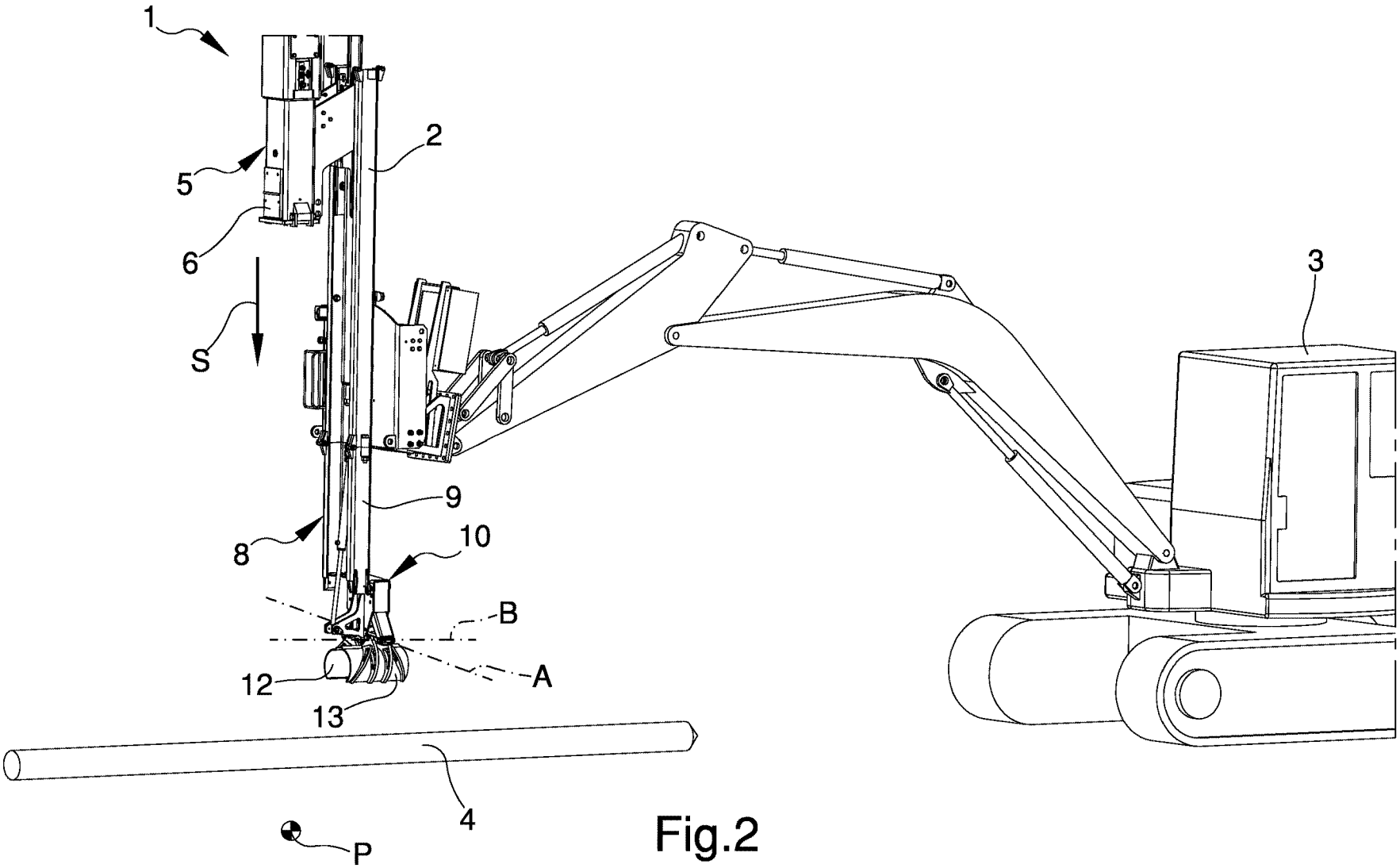

Subsequently, as shown in FIG. 2, the first actuating means 11 are operated in order to position the gripping device 10 in the gripping position, i.e. the gripping device 10 is made to rotate around the axis of rotation A and is brought closer to the ground at the pole 4 which must be buried into the ground.

Precisely, the gripper 12, 13 is located in the proximity to the pole 4.

Figure 3:
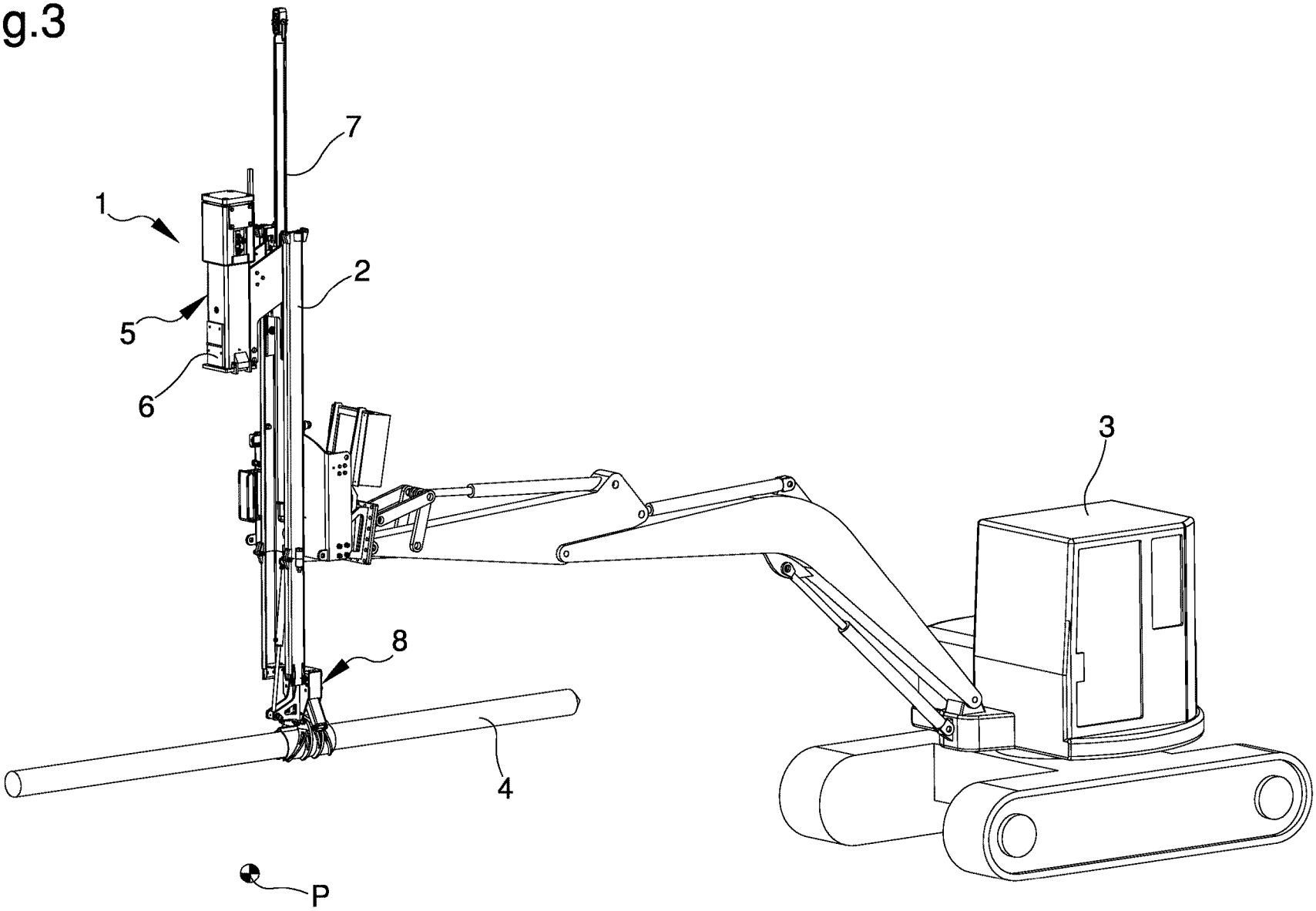

Then the gripper 12, 13 is positioned in the gripping position and the first jaw 12 and the second jaw 13 grasp the pole 4, as can be seen in FIG. 3.

Figure 4:
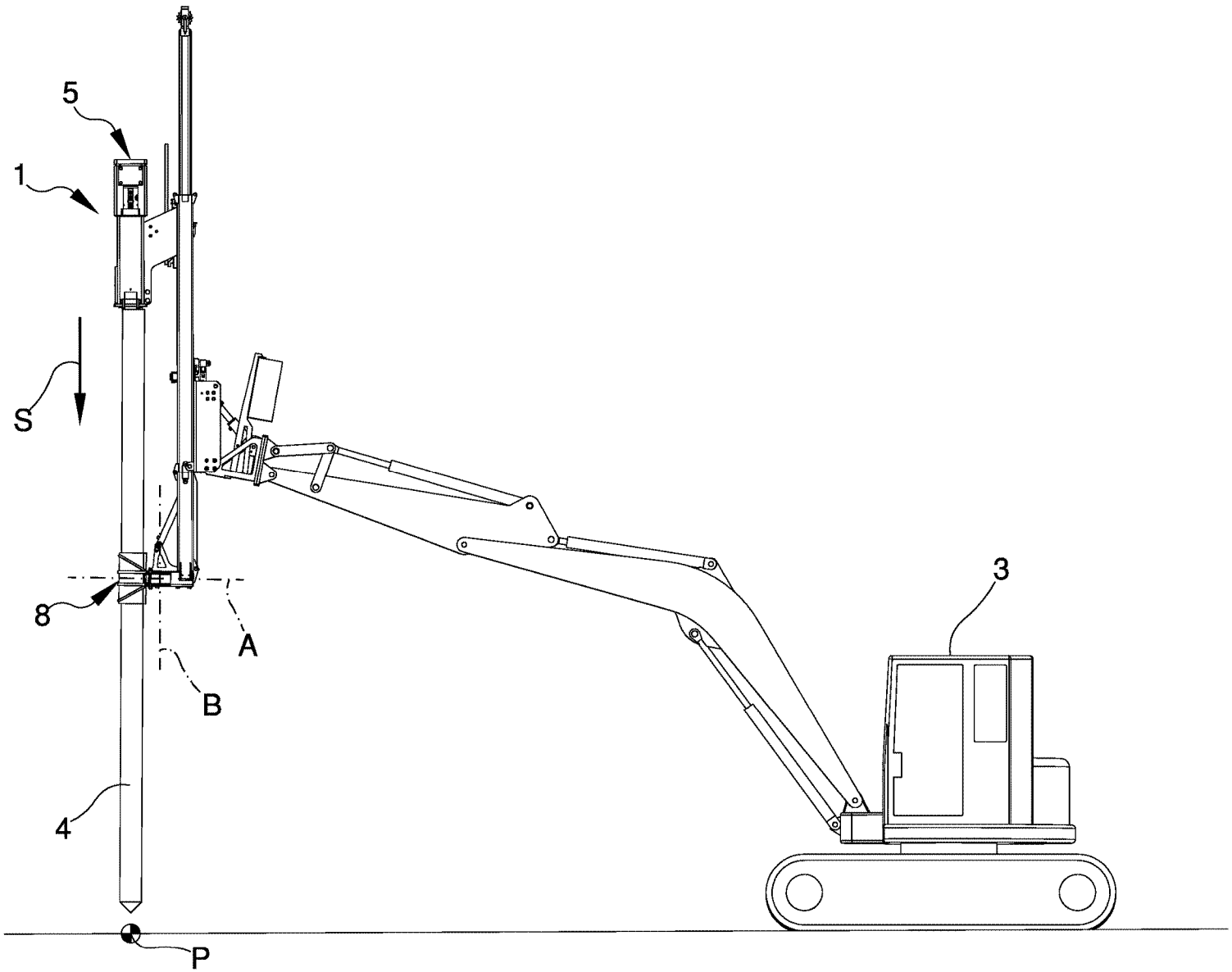

Then, as shown in FIG. 4, the first actuating means 11 position the gripping device 10 in the work position and the pole 4 is then positioned vertically under the hammering assembly 5.

Next, the machine for the movement 3 moves the equipment 1 so that the pole 4 is exactly at the burying position P.

Figure 5:
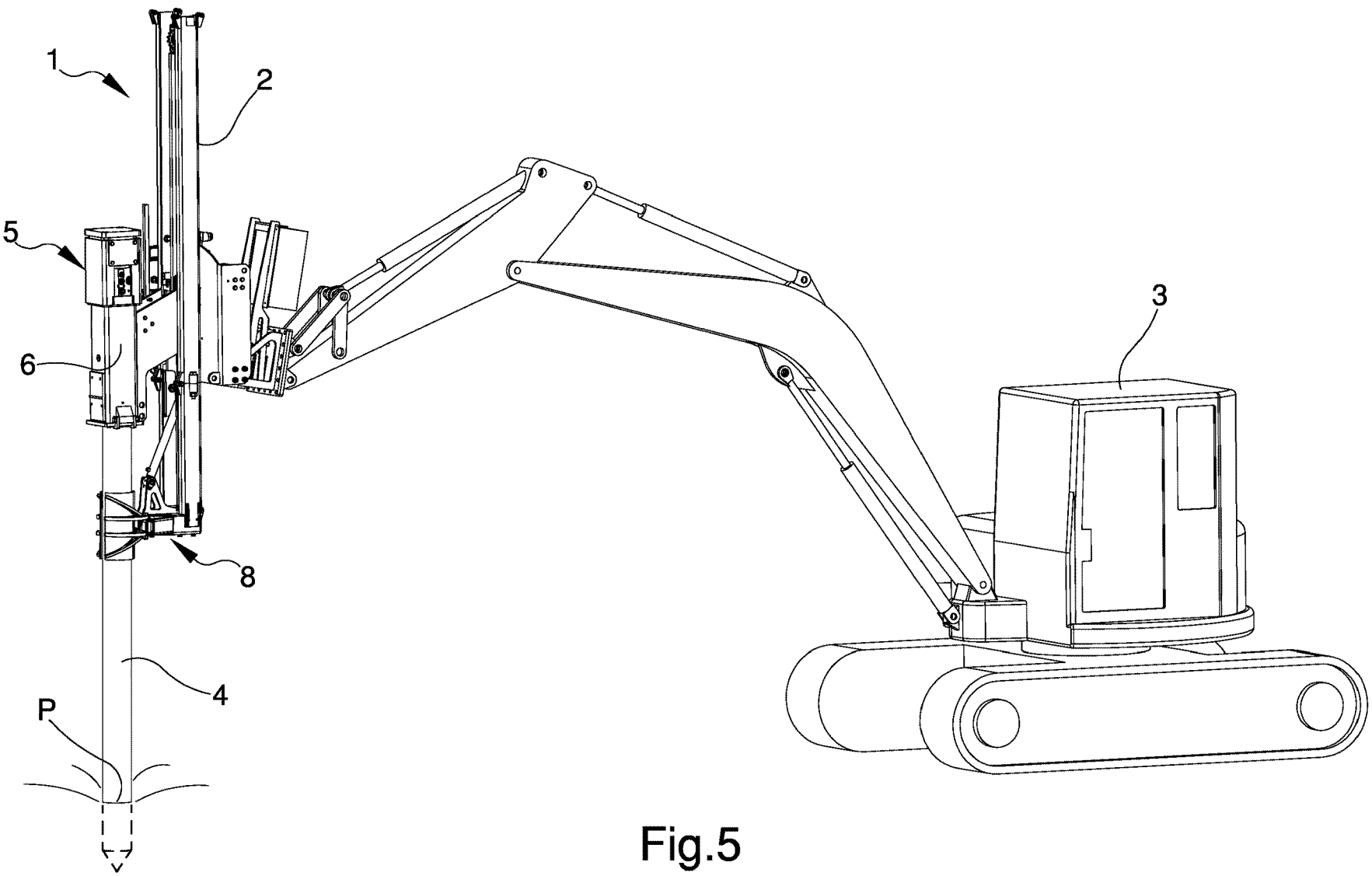

The hammering assembly 5 is made to slide along the sliding direction S thanks to the activation of the operation means 7 and pushes the pole 4 into the ground, as shown in FIG. 5.

Figure 6:
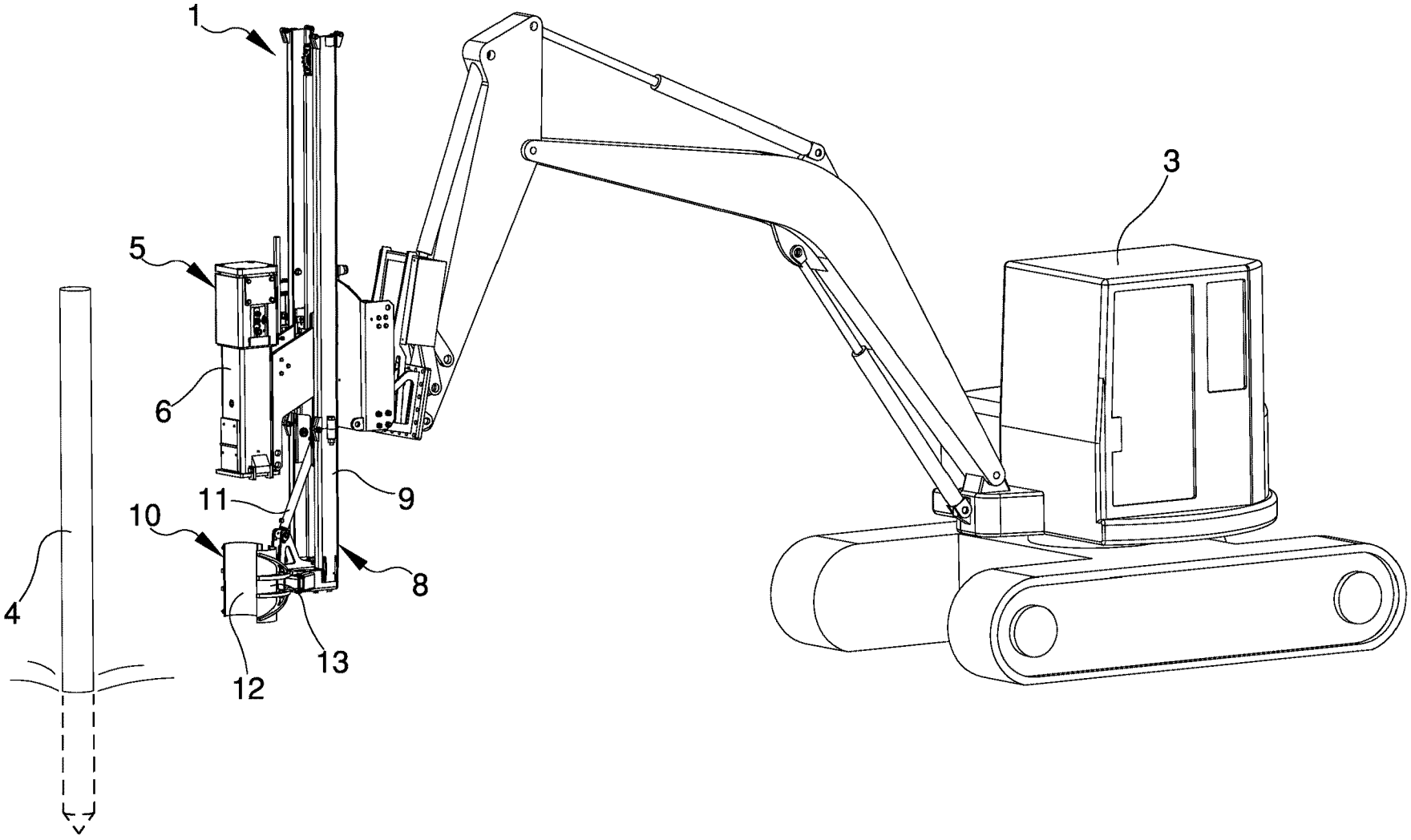

During this operation, the second actuating means 14 locate the gripper 12, 13 to the release position and the pole 4 is released from the gripper 12, 13 remaining buried in the ground, as shown in FIG. 6.

In addition, thanks to the system for the control of the machine to which the present invention relates, the operator can initially communicate the burying position P to the management and control unit, which stores it in the storage unit.

Subsequently, the location unit detects the position of the equipment 1 on the ground and the management and control unit allows the operator to simultaneously show the position of the equipment 1 and the burying position P on the display.

The operator, thanks to the control means, can easily operate on the machine for the movement 3 in order to locate the equipment 1 at the burying position P.

Then the operator, by means of the control means, can adjust the operation of the first actuating means 11, of the second actuating means 14 and of the operation means 7 in order to control the grip and the positioning of the pole 4 at the burying position P and its subsequent burying into the ground by the hammering assembly 5.

It has, in practice, been found that the described invention achieves the intended objects.

In particular, it should be noted that the presence of the gripping and positioning assembly makes it possible to easily and safely perform the phase of burying the poles into the ground.

In fact, the gripping and positioning assembly allows the burying phase to be carried out fully automatically without an operator having to be in the proximity to the pole during this operation.

In particular, the pole burying phase can be carried out by the same operator who controls the machine for the movement.

Therefore, thanks to the presence of the gripping and positioning assembly, the use of manpower is reduced, operations are speeded up and it is possible to operate in complete safety on all types of soil and on poles of any weight and size.

Moreover, the presence of the system for the automatic control of the equipment to which the present invention relates, makes it possible to carry out the ground mapping phase quickly and easily while reducing, at the same time, the use of manpower and the timing of implementation.

It is sufficient, in fact, that an operator provides the system with the mapping of the burying positions and, through the control means, can easily position the equipment at the burying positions themselves and at the same time can manage the operation of the equipment itself during the process of burying the pole into the ground.

In particular, the presence of a satellite-type location device makes it possible to significantly increase the accuracy of the location of the burying positions themselves.

The invention claimed is:

1. Equipment for burying poles into the ground, said equipment comprising:

at least one base frame associable with at least one machine for the movement of said equipment; and at least one hammering assembly associated movable with said at least one base frame and adapted to bury at least one pole to allow said at least one pole to at least partial penetration into the ground at a burying position, wherein at least one gripping and positioning assembly of said at least one pole, associated with said at least one base frame and adapted to grasp said at least one pole and to position said at least one pole under said at least one hammering assembly at said burying position, wherein said at least one gripping and positioning assembly comprises at least one gripping device movable between:

at least one gripping position wherein said at least one gripping device is placed to grasp said at least one pole positioned on the ground; and at least one work position wherein said at least one gripping device is placed to position said at least one pole vertically under said at least one hammering assembly, and wherein said at least one gripping and positioning assembly comprises at least one arm fixed to said at least one base frame, said at least one gripping device being associated with said at least one arm in a rotatable manner.

2. The equipment according to claim 1, wherein said at least one gripping device is hinged to said at least one arm around a substantially horizontal axis of rotation.

3. The equipment according to claim 2, wherein said at least one gripping device comprises at least one gripper associated with said at least one arm and movable between at least one gripping position, wherein said at least one gripper is placed to retain said at least one pole and at least one release position, wherein said at least one gripper is placed to free said at least one pole.

4. The equipment according to claim 3, wherein said at least one gripper comprises at least a first jaw and at least a second jaw mutually opposite and associated with said at least one arm in a rotatable manner.

5. The equipment according to claim 4, further comprising:

first actuating means associated with said at least one arm and with said at least one gripping device and adapted to move said at least one gripping device between said at least one gripping position and said at least one work position.

6. The equipment according to claim 5, wherein said first actuating means comprise at least a first actuating cylinder associated with said at least one arm and with said at least one gripping device.

7. The equipment according to claim 5, further comprising:

second actuating means associated with said at least one arm and with said at least one gripper and adapted to move said at least one gripper between said at least one gripping position and said at least one release position.

8. The equipment according to claim 1, wherein said at least one hammering assembly comprises at least one hammering device associated with said at least one base frame sliding along a substantially vertical sliding direction.

9. The equipment according to claim 8, wherein said at least one hammering assembly comprises operation means associated with said at least one base frame and with said at least one hammering device and adapted to move said at least one hammering device along said substantially vertical sliding direction.

10. A system for the automatic control of the equipment for burying said poles into the ground according to claim 9, wherein the system comprises:

at least one management and control assembly of said system;

at least one storage assembly of at least one burying position of said at least one pole to be buried into the ground through said equipment, said storage assembly being operationally connected to said at least one management and control assembly;

at least one location assembly operationally connected to said at least one management and control assembly and adapted to identify the position of said equipment;

at least one display to show or display said at least one burying position and a position of said equipment; and control means of said equipment.

11. The system according to claim 10, further comprising:

means for defining at least one route starting from said position of said equipment to said at least one burying position.

12. The system according to claim 11, wherein said at least one storage assembly is adapted to store a plurality of said at least one burying positions.

13. The system according to claim 10, further comprising:

acquisition means of said at least one burying positions, said acquisition means being operationally connected to said at least one management and control assembly.

14. Equipment for burying poles into the ground, said equipment comprising: at least one base frame associable with at least one machine for the movement of said equipment; and at least one hammering assembly associated movable with said at least one base frame and adapted to bury at least one pole to allow said at least one pole to at least partial penetration into the ground at a burying position, wherein at least one gripping and positioning assembly of said at least one pole, associated with said at least one base frame and adapted to grasp said at least one pole and to position said at least one pole under said at least one hammering assembly at said burying position, wherein said at least one hammering assembly comprises at least one hammering device associated with said at least one base frame sliding along a substantially vertical sliding direction, wherein said at least one hammering assembly comprises operation means associated with said at least one base frame and with said at least one hammering device and adapted to move said at least one hammering device along said substantially vertical sliding direction, wherein a system for the automatic control of the equipment for burying said poles into the ground, wherein the system comprises:

at least one management and control assembly of said system;

at least one storage assembly of at least one burying position of said at least one pole to be buried into the ground through said equipment, said storage assembly being operationally connected to said at least one management and control assembly;

at least one location assembly operationally connected to said at least one management and control assembly and adapted to identify the position of said equipment;

at least one display to show or display said at least one burying position and a position of said equipment and control means of said equipment, wherein said control means are operationally connected to said a first actuating means, to a second actuating means and to said operation means.

* * * * *